US010428449B1

(12) United States Patent
Cuneo

(10) Patent No.: US 10,428,449 B1
(45) Date of Patent: Oct. 1, 2019

(54) METHOD FOR CREATING ASTRONOMY-BASED ORNAMENTAL ARTICLES

(71) Applicant: Renee Cuneo, Princeton, NJ (US)

(72) Inventor: Renee Cuneo, Princeton, NJ (US)

( * ) Notice: Subject to any disclaimer, the term of this patent is extended or adjusted under 35 U.S.C. 154(b) by 168 days.

(21) Appl. No.: 15/406,742

(22) Filed: Jan. 15, 2017

(51) Int. Cl.

| | |
|---|---|
| ***D04D 1/04*** | (2006.01) |
| ***A44C 27/00*** | (2006.01) |
| ***A44C 17/04*** | (2006.01) |
| ***A44C 17/02*** | (2006.01) |

(52) U.S. Cl.
CPC ..... *D04D 1/04* (2013.01); *A44C 17/0241* (2013.01); *A44C 17/04* (2013.01); *A44C 27/00* (2013.01)

(58) Field of Classification Search
CPC .. D04D 1/04; A44C 17/0208; A44C 17/0241; A44C 17/025; A44C 17/04; A44C 27/00
See application file for complete search history.

(56) References Cited

U.S. PATENT DOCUMENTS

| | | | |
|---|---|---|---|
| 2005/0098949 | A1 | 5/2005 | Roth |
| 2011/0110201 | A1 | 5/2011 | Boularas |
| 2012/0331422 | A1 | 12/2012 | High |
| 2016/0081441 | A1 | 3/2016 | Sohal |

FOREIGN PATENT DOCUMENTS

| | | | |
|---|---|---|---|
| DE | 202006002043 | U1 | 4/2006 |
| JP | 3026527 | U | 7/1996 |
| JP | 2003135113 | A | 5/2003 |
| JP | 2007044097 | A | 2/2007 |
| NL | 1024974 | C1 | 6/2004 |

OTHER PUBLICATIONS https://www.etsy.com/no-en/listing/185868866/leo-constellation-brooch-s . . .—"LEO Constellation Brooch—sterling silver and natural gemstones: red rubies and green peridot—Ready to Ship"—vdeux—Oct. 4, 2016—pp. 1-3.
https://www.etsy.com/listing/93296374/capricom-zodiac-gemstone-accented . . . —"Capricorn Zodiac Gemstone Accented Pendant Long Necklace in 14K Gold Plated, constellation, long necklace, December birthday"—MazuMazu—Oct. 4, 2016—pp. 1-3.
http://www.thejewelleryeditor_com/jewellery/map-out-your-star-sign-diamonds-zodiac-jewelleryastrology/Published/Access—"Map out your star sign in diamonds"—The Jewellery Editor—Oct. 4, 2016—pp. 1-3.
http://www.luulla.com/product/488763/scorpio-earrings-cz-constellation-earrings-gold-silver-zodiacearrings-tiny-round-earrings-star-jewe—"Scorpio earrings,CZ constellation earrings,gold,silver,zodiac earrings,tiny round earrings,star jewelry,horoscope,astrology,birth month,wedding gift,5NABE58,Stuffit"—STUFFIT—Oct. 4, 2016—pp. 1-2.

*Primary Examiner* — Christopher J Besler
(74) *Attorney, Agent, or Firm* — Lippincott IP, LLC; Patricia Werschulz

(57) ABSTRACT

A method for creating original jewelry pieces by creating a star chart based on a specific time and a specific place, classifying stars by magnitude, creating a template based on the star chart, indicating position and magnitude for each star, transferring the chart onto a transparency by overlaying the transparency onto the template, matching a plurality of gemstones to the stars in the star chart, the lower the magnitude of the star, the larger the gemstone, and creating the jewelry piece by replicating the transparency, placing a gemstone matching the magnitude of the star onto the matching position of the star on the template. The original jewelry piece can be a multiple strand piece or a solid piece.

13 Claims, 11 Drawing Sheets

METHOD FOR CREATING ASTRONOMY-BASED ORNAMENTAL ARTICLES

TECHNICAL FIELD

The present disclosure relates generally to a method and a system for designing and creating ornamental articles. More particularly, the present disclosure relates to a method and system for creating astronomy-based jewelry.

BACKGROUND

People have star gazed since the beginning of time. The ancients realized that stars form special patterns in the sky that vary over the course of a year. Many ancient cultures commonly attributed something special to how the stars aligned in the sky at a point in time.

Many people attribute their success or failure in life to the stars they were born under. People commonly "thank their lucky stars" when they have something fortuitous happen. Conversely, when things go awry, such as when a couple divorces, they blame the stars and say that the wedding took place under a bad sign, referring to the signs of the zodiac, an ancient way of organizing how the stars appear.

Most people refer to astrology when they talk about fate, the stars and star signs. Astrology is based on the belief that the dominant constellation of stars at the time of a person's birth dictate their personality and fate. This is based on the ancient Greek system of zodiacal signs. Particular patterns of stars such as constellations were given names and representations. The year was divided into twelve segments and each segment assigned a name based on which constellation was dominate in the night sky in ancient Babylonia.

However, the night sky today does not appear the same as it did many millennia ago, due the constant movement of the Earth and the stars as the universe expands. The constellation that was dominant in the sky in a particular month in ancient Babylonia now appears at a different time in the solar year, yet zodiacal signs are assigned to birthdays based on the Babylonian calendar. The zodiacal signs have little relevance to people who live in the southern hemisphere since these star patterns are never visible there. Astrological signs only consider the date of birth, not the location and when the date occurs on the now-inaccurate astrological calendar.

Once a person knows their astrological sign, they often use their zodiacal sign as a decorative element for jewelry, clothing and even household goods, such as coffee mugs. While these persistent beliefs and customs may be suitable for the particular purpose employed, or for general use, they would not be as suitable for the purpose of memorializing other events in their lives.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a method that memorializes an event in a person's life. Accordingly, an aspect of an example embodiment in the present disclosure provides a method of creating a piece of jewelry showing the stars in the sky at the specific time of the event.

Another aspect of an example embodiment in the present disclosure is to provide a method that memorializes where an event in a person's life took place. Accordingly, an aspect of an example embodiment in the present disclosure provides a method of creating a piece of jewelry showing the stars in the sky at the specific time of the event at a specific place defined by longitude and latitude.

A further aspect of an example embodiment in the present disclosure is to provide a method that accurately represents the stars in the sky at a specific time and a specific place of an event. Accordingly, an aspect of an example embodiment in the present disclosure provides a method of creating a piece of jewelry showing the stars according to their brightness, the brighter stars represented by larger gemstones than the dimmer stars.

The present disclosure describes a method for creating original jewelry pieces by creating a star chart based on a specific time and a specific place, classifying stars by magnitude, creating a template based on the star chart, indicating position and magnitude for each star, transferring the chart onto a transparency by overlaying the transparency onto the template, matching a plurality of gemstones to the stars in the star chart, the lower the magnitude of the star, the larger the gemstone, and creating the jewelry piece by replicating the transparency, placing a gemstone matching the magnitude of the star onto the matching position of the star on the template. The original jewelry piece can be a multiple strand piece or a solid piece.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Herein is a description of methods and systems for creating jewelry that recreates a star pattern that occurred or will occur at a specific time and a specific place. This jewelry memorializes that time and that place which can be a special moment in a person's life. While many may choose their birthdate and birthplace, others may choose their wedding day, graduation day, engagement or other momentous events in their lives.

Figure 1:
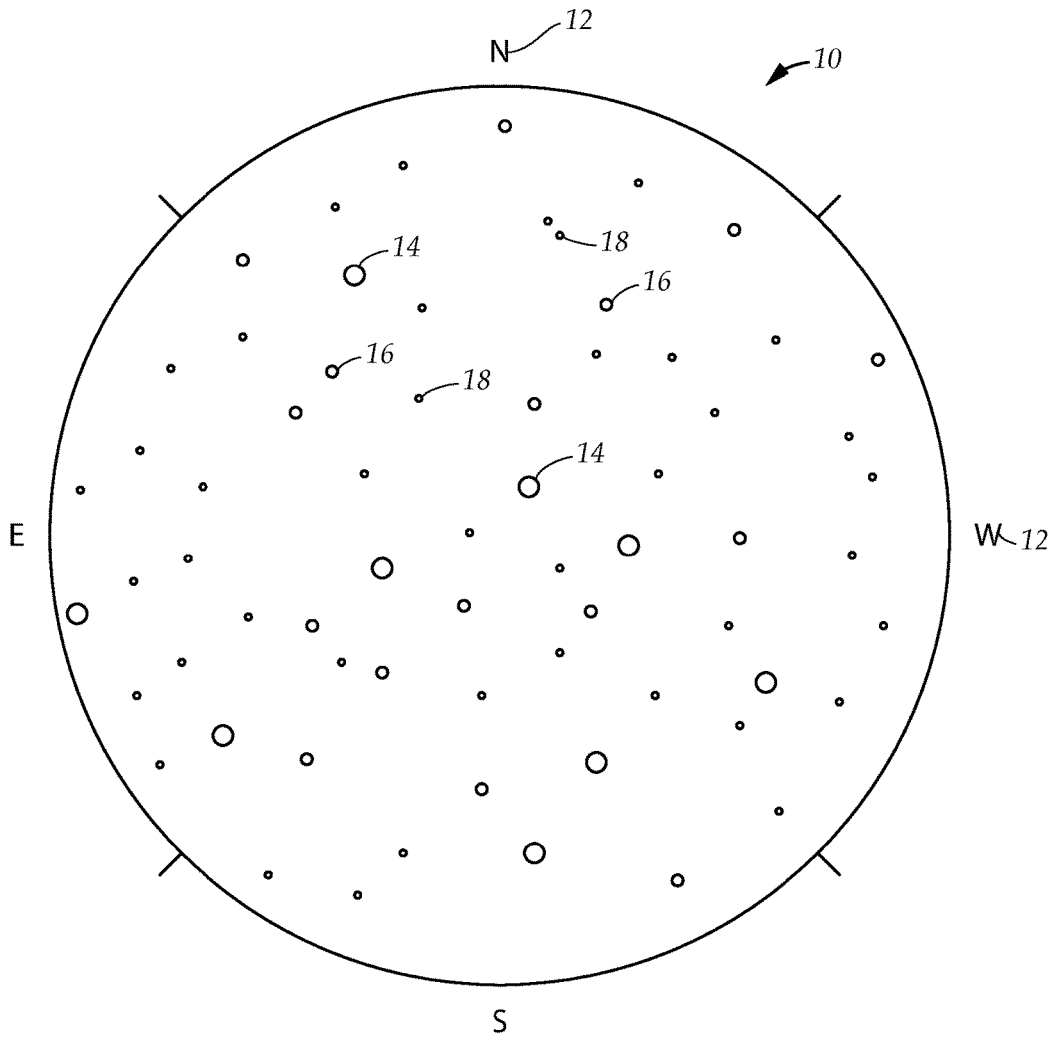
FIG. 1 is star chart determined by a specific place and a specific time.

FIG. 1 illustrates a star chart 10 based on the specific time and the specific place that is to memorialized. The star chart 10 is preferably a chart showing stars in all cardinal directions or compass points 12, giving a 360° view of the sky above. Other star charts are possible such as those generated from the perspective of a specific compass point or even a chart that removes the earth from the view, producing a chart with stars below the horizon. The star chart perspective is not a limitation of the method.

The user generates the star chart 10 using one or more software applications that generate star charts or sky views. The star chart is generated using a specific place that is defined by a longitude and a latitude and a specific time that is defined by a date and a point in time. The point in time is defined in terms of hours and minutes that includes the time zone for the specific place or alternatively is expressed as hours and minutes in Coordinated Universal Time (UTC).

Note that FIG. 1 is illustrative only and approximates an actual star chart generated for New York City, having a latitude of 40.7° North and 74° West. The specific time is 11 pm Eastern Standard Time on Feb. 14, 2017. The illustration shows that a star chart can be generated for times in the future as well as in the past. Further, star charts can be generated for times, such as during daylight hours, when stars are not visible to the unaided eye.

The star chart showing a plurality of stars and their relative brightness is represented by different size circles. As it is well known to those of ordinary skill, the brightest stars have the lowest value of magnitude, with the brightest stars reaching negative values. Magnitude is a logarithmic measure of the brightness, so that the difference between a star with a magnitude of 1.0 and a star with a magnitude of 2.0 is a factor of ten. For the purposes of the methods and systems disclosed hereinbelow, the term magnitude is used for apparent magnitude, that is the brightness of the star as it appears in the night sky from Earth. However, this is not a limitation and the methods and systems can employ either the apparent magnitude or absolute magnitude when generating the star chart, but apparent magnitude is the preferable method.

In FIG. 1, three different classes of stars are shown based on magnitude, the brightest stars 14 having a magnitude of 1.0--1.45, the intermediate magnitude stars 16 having a magnitude of 1.0-2.0 and the highest magnitude stars 18 having a magnitude of 2.0-2.5. For the purposes of the illustration, the stars have been divided into three classes. It is understood that the number of classes is arbitrary and the number of classes of star magnitudes is determined by the number of sizes and types of gemstones available for the jewelry as explained hereinbelow.

Generating the star chart 10 is performed by one or more software applications that produce planetarium projections. Creating the star chart is preceded by the step of gathering and comparing scientific data from at least one sources.

In the present example, a first star chart was generated by Stellarium, a free open source application. The accuracy of the star chart was checked using Your Sky, from Fourmilab. This software package was created by John Walker and creates custom star charts. These are two non-limiting examples of software applications available that produce star charts based on a specific place and a specific time. The software provides the star charts and include data concerning magnitude and location in the sky for the specific time and the specific place.

Figure 2:
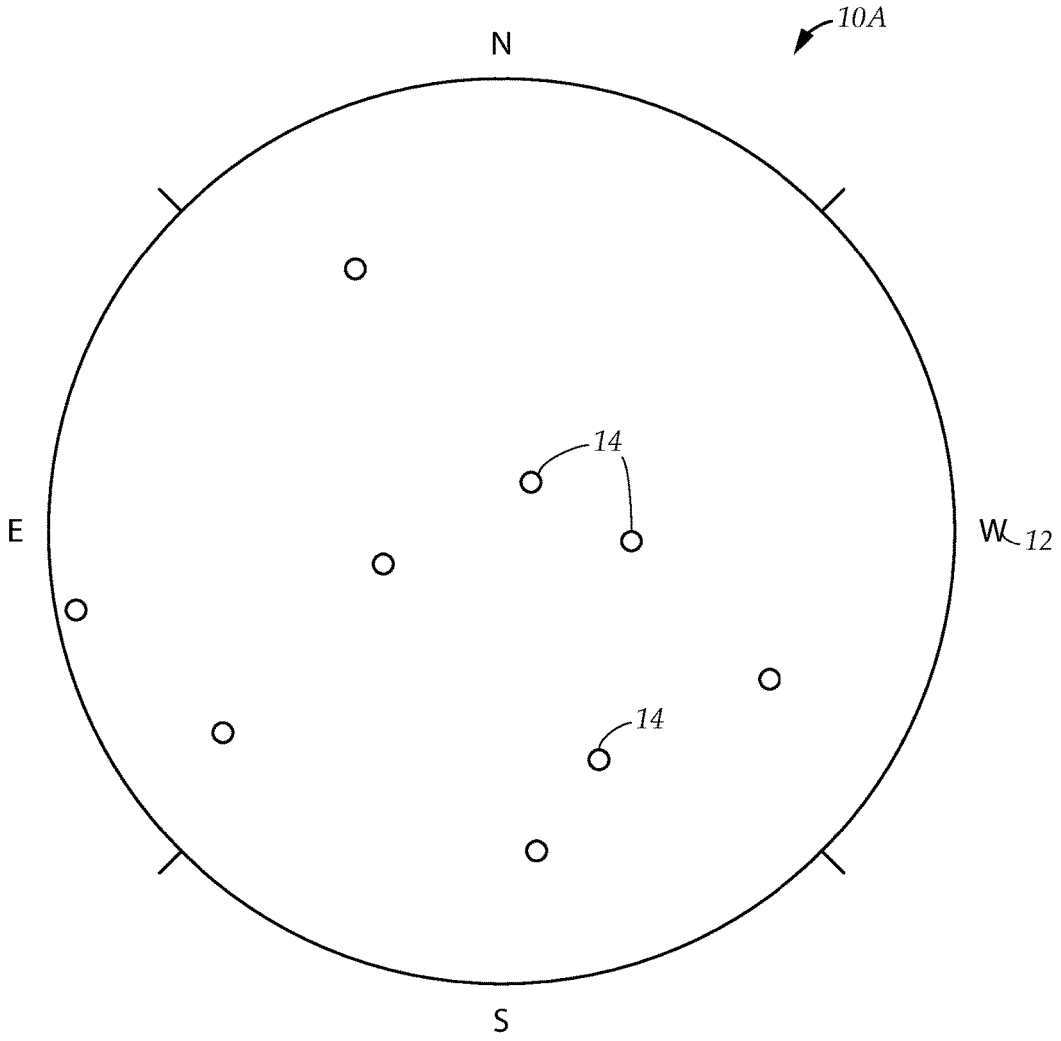
FIG. 2 is the star chart showing a plurality of stars of greatest brightness and lowest magnitude determined by the specific place and the specific time.
Figure 3:
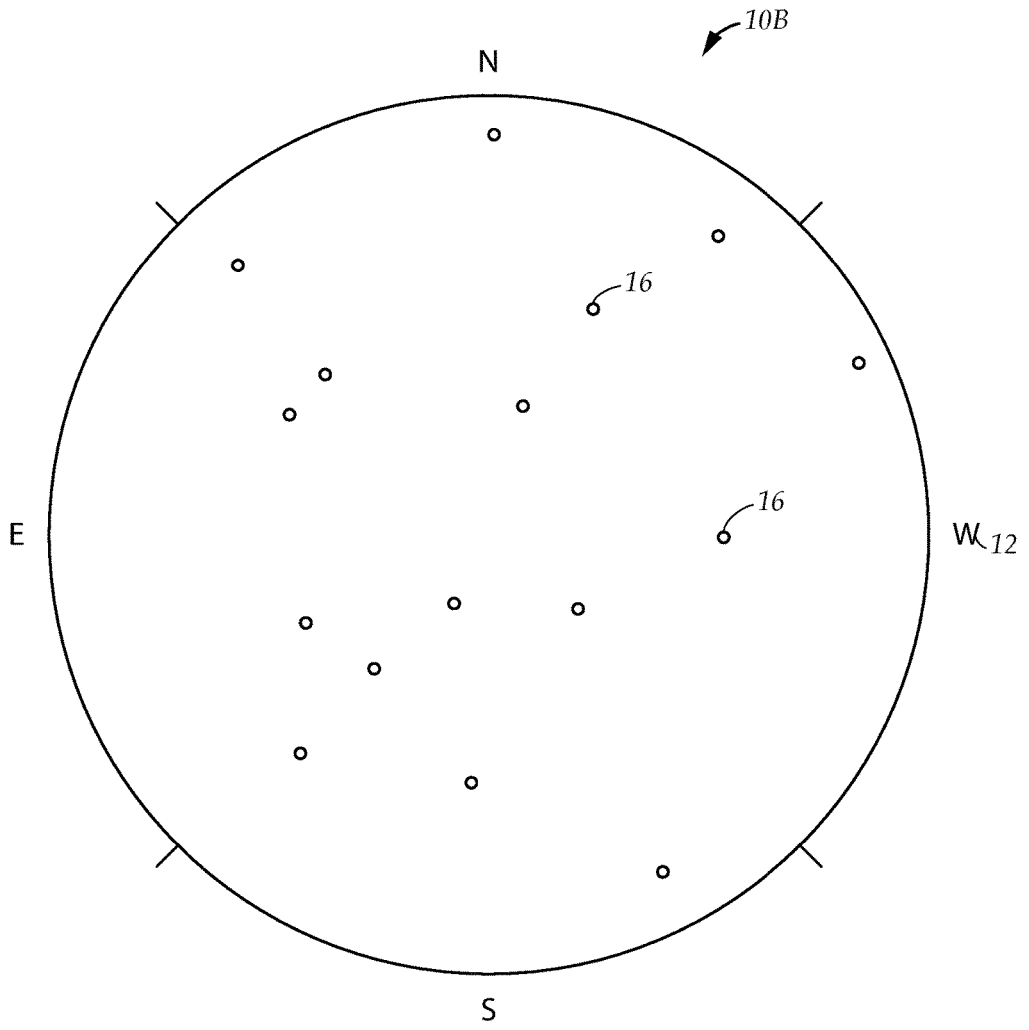
FIG. 3 is the star chart showing a plurality of stars of intermediate brightness and intermediate magnitude determined by the specific place and the specific time.
Figure 4:
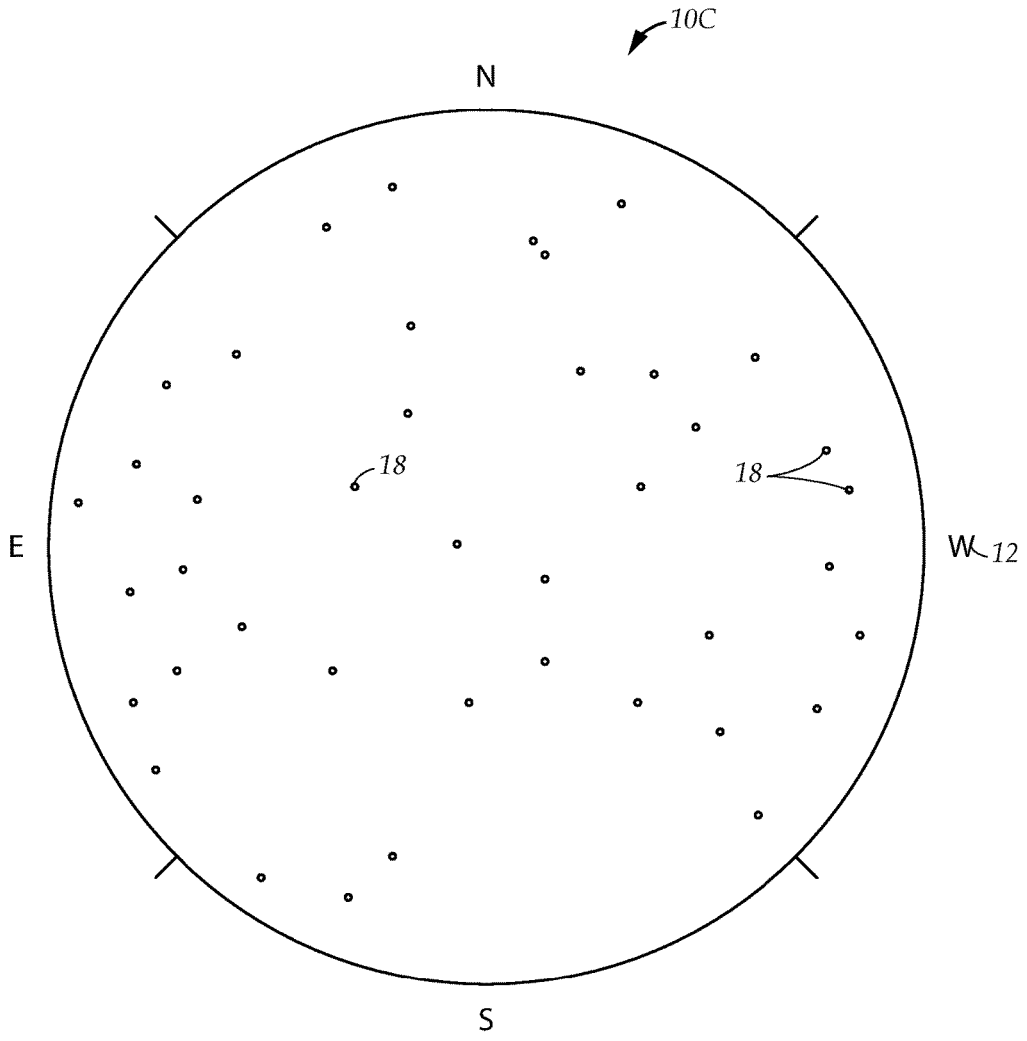
FIG. 4 is the star chart showing a plurality of stars of largest magnitude determined by the specific place and the specific time.

FIGS. 2-4 show subsets of the star chart, showing stars within a magnitude range. FIG. 2 shows the star chart 10A with the brightest stars 14 having a magnitude of 1.0--1.45. FIG. 3 shows the star chart 10B with the intermediate magnitude stars 16 having a magnitude of 1.0-2.0. FIG. 4 shows the star chart 10C with the highest magnitude stars 18 having a magnitude of 2.0-2.5. Using various filters in the software applications, these star charts can be further refined and specific stars identified by name. The stars included in the chart 10 can be limited by a range of the magnitude of the stars, eliminating a star with a magnitude greater than a specified range, thereby including only relatively bright stars and eliminating those not normally visible.

Figure 5:
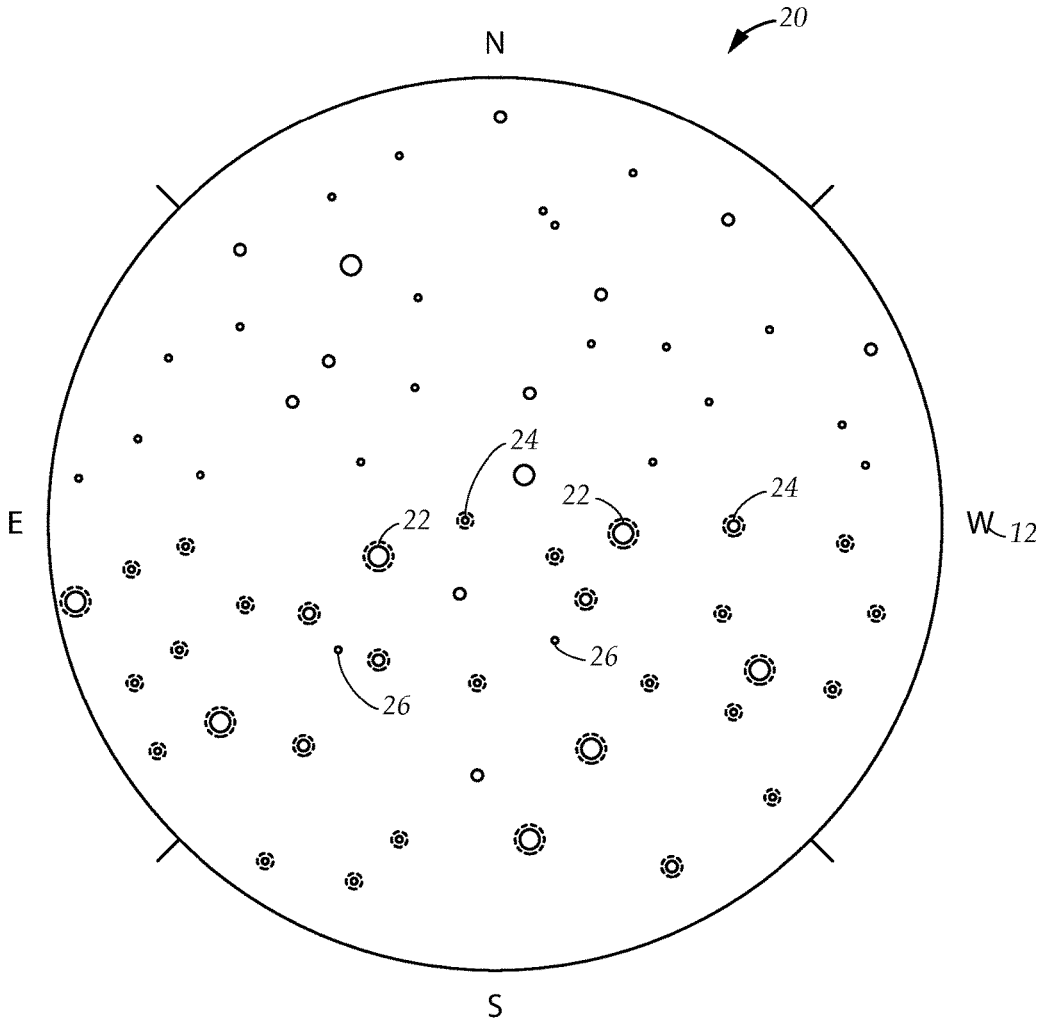
FIG. 5 is a template created from the star chart.

FIG. 5 shows a template 20 based on the star chart 10 shown in FIG. 1. The template 20 is preferably drawn on graph paper, but this is not a limitation. The template 20 is created using data on the magnitude of the stars drawn from the star chart 10 and the subsets shown in FIGS. 1-4. The stars are marked by using different colors or symbols for each magnitude range. In the template 20, the brightest stars have a dotted line around a circle as a brightest star symbol 22 and the intermediate stars have a different pattern around a circle as an intermediate brightness symbol 24, since color cannot be shown in these illustrations. The highest magnitude stars are indicated in this figure by a plain circle symbol 26. The stars included in the template 20 can be limited by a range of the magnitude of the stars, eliminating a star with a magnitude greater than a specified range.

These star positions and star magnitudes symbols 22, 24, 26 are transferred to a jewelry transparency. The steps of the method described hereinabove is the same for all types of jewelry. Different steps follow depending on whether the jewelry piece is a multiple strand piece or a solid piece and whether the shape of the jewelry piece is arcuate or linear. For example, a multiple strand piece of jewelry can be arcuate, such as a necklace or linear such as a belt, earrings, a bracelet or an anklet. A solid piece of jewelry can be arcuate such as a collar or linear such as a cuff bracelet, as non-limiting examples.

Figure 6:
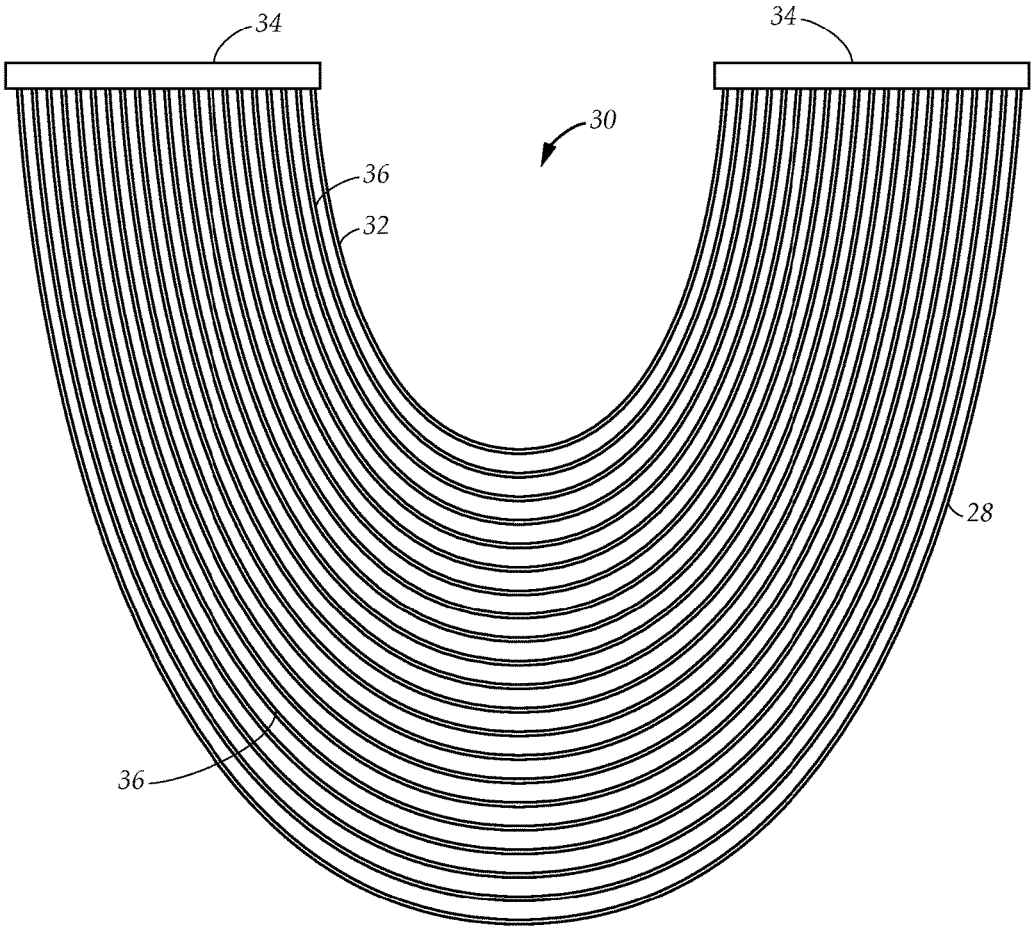
FIG. 6 is a transparency for a multiple strand arcuate jewelry piece.
Figure 7:
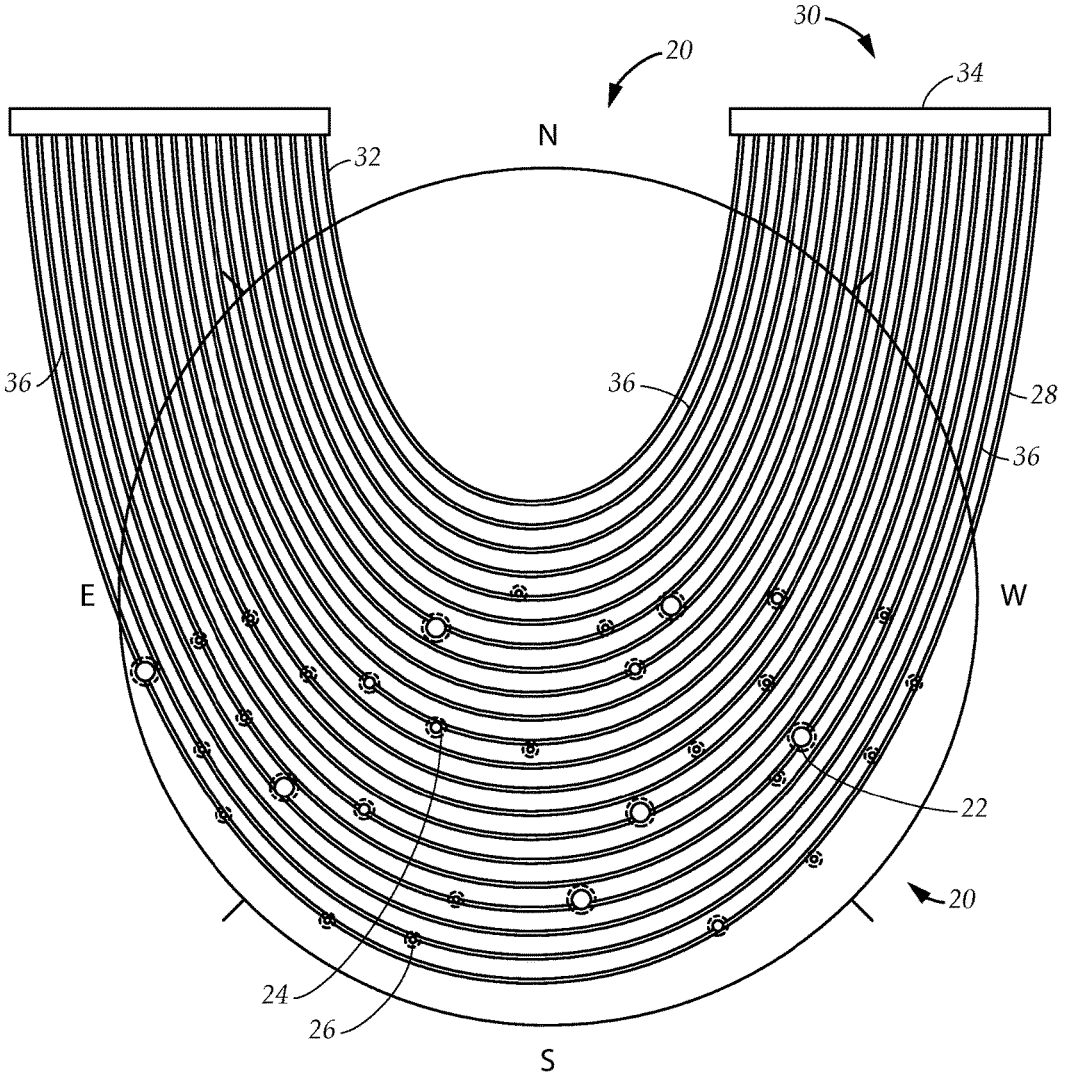
FIG. 7 is a top plan view of the multiple strand arcuate jewelry piece transparency overlaying the template.

Referring to FIGS. 6-7, the steps for creating a multiple strand arcuate piece are illustrated. In FIG. 6, a transparency 30 is shown. The transparency 30 comprises a plurality of lines 36 indicating a plurality of strands in the multiple strand jewelry, with an innermost line 32 and an outermost line 28. It is understood that the number of strands is not a limitation. The transparency 30 further indicates placement of a pair of members 34 of a dual clasp.

In FIG. 7, the star positions and star magnitudes are transferred onto the multiple strand jewelry transparency 30 by overlaying the multiple strand jewelry transparency 30 on top of the template 20 and marking the star position and star magnitude symbol 22, 24, 26 onto a line 36 on the transparency.

The step of transferring the star positions and star magnitudes symbols 22, 24, 26 includes adjusting the multiple strand jewelry transparency 30 over the template 20 to create an aesthetically pleasing, balanced representation of how the stars in the sky would appear.

Figure 8:
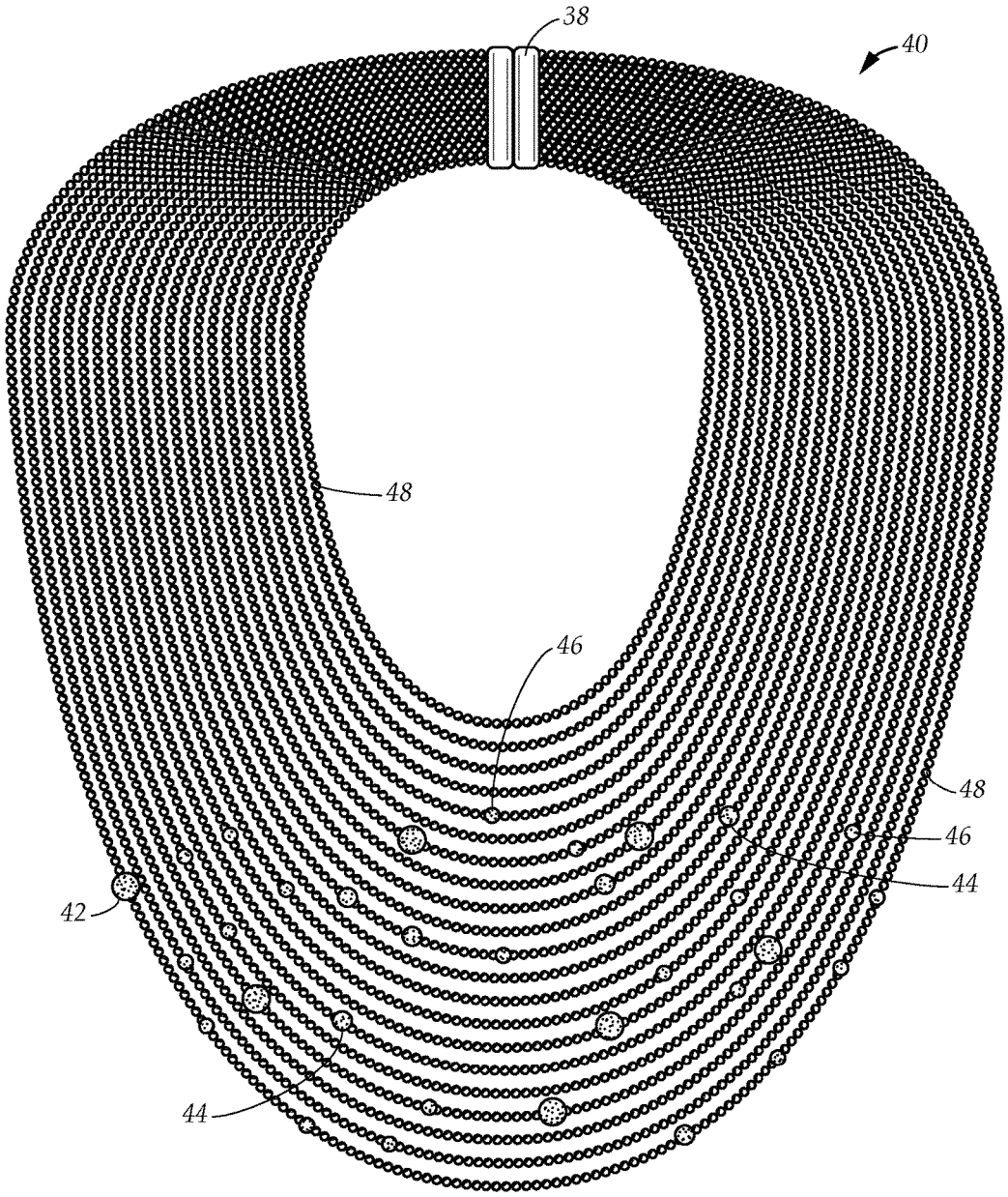
FIG. 8 is a front elevation view of a multiple strand necklace with a plurality of stones positioned according to the transparency.

To create the final jewelry piece 40 shown in FIG. 8, a plurality of gemstones 42, 44, 46 are matched to the star magnitude symbols 22, 24, 26, the lower the magnitude of the star, the larger the gemstone. A plurality of strands 48 in the multiple strand piece 40 are formed by replicating the transparency shown in FIG. 7, stringing a gemstone matching the magnitude of the star symbol onto the strand matching the position of the star symbol on the transparency 30. The larger gemstones 42 are placed where the brightest star magnitude symbol 22 is indicated on the transparency 30; the smallest gemstone where the highest magnitude symbol 26 is indicated and the intermediate size gemstone 44 where the intermediate magnitude symbol 24 is indicated.

At least one type of gemstone is used, and can be chosen based on ancient symbolism. For example, aquamarine is associated with serenity, amethyst with protection, diamond with inner strength, gold with self-reflection and generosity and pearls with integrity and love.

The term gemstone used in this disclosure includes precious stones, semi-precious stones, artificial stones, such as cubic zirconia, synthetic stones, crystals, minerals, organic materials, such as amber, jet, pearl, base and fine metals, such as gold and silver and polymeric materials, such as acrylic and polymeric clay.

Further, a different gemstone can be used to indicate star magnitude, such as pearls for the brightest stars, gold for the intermediate magnitude stars and diamond for the highest magnitude stars. The combinations of gemstones and how they are matched to the magnitude of stars is limitless and infinite.

Further, in the examples in the illustrations, the stars were classified into three classes based on magnitude. While this is preferable, the number of classes is not a limitation. The step of classifying the plurality of stars in the star chart by magnitude includes the steps of classifying the gemstones selected for a piece by sizes and types, determining the number of classes of gemstones available and classifying the plurality of stars into the same number of classes as the gemstones. For example, if the gemstone is pearl and there are four sizes of pearls available, the classes could be the brightest stars having a magnitude of 0.0--1.45, the brighter intermediate magnitude stars having a magnitude of 0.0-1.0, the higher magnitude stars having a magnitude of 1.0-2.0 and the highest magnitude stars having a magnitude of 2.0-2.5.

Referring to FIGS. 7 and 8, once the strands 48 are created, the strands having a pair of ends, a dual clasp 38 is attached to the ends of strands, the dual clasp 38 having two members 34, one part to the end of each strand 48, maintaining the strands in position replicating the transparency 30 shown in FIG. 7.

Figure 9:
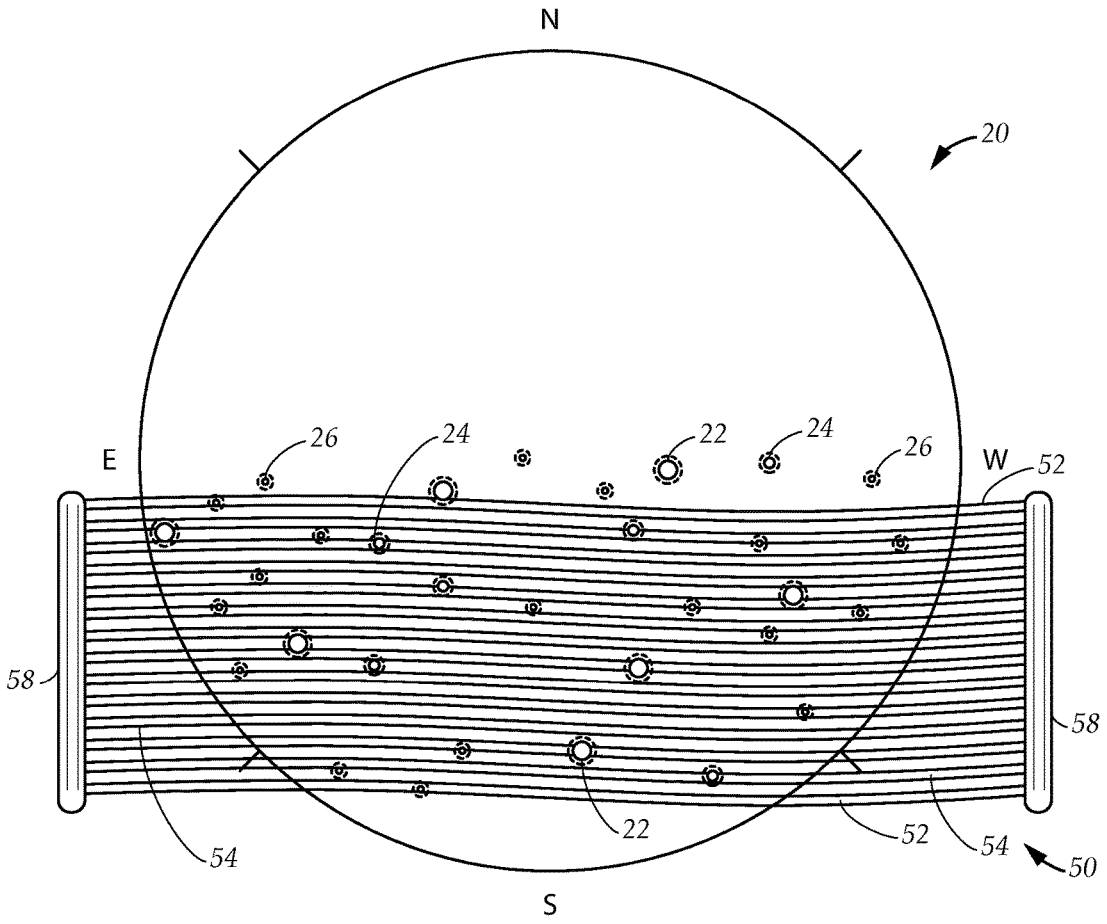
FIG. 9 is a top plan view of a multiple strand linear jewelry piece transparency overlaying the star chart template.
Figure 10:
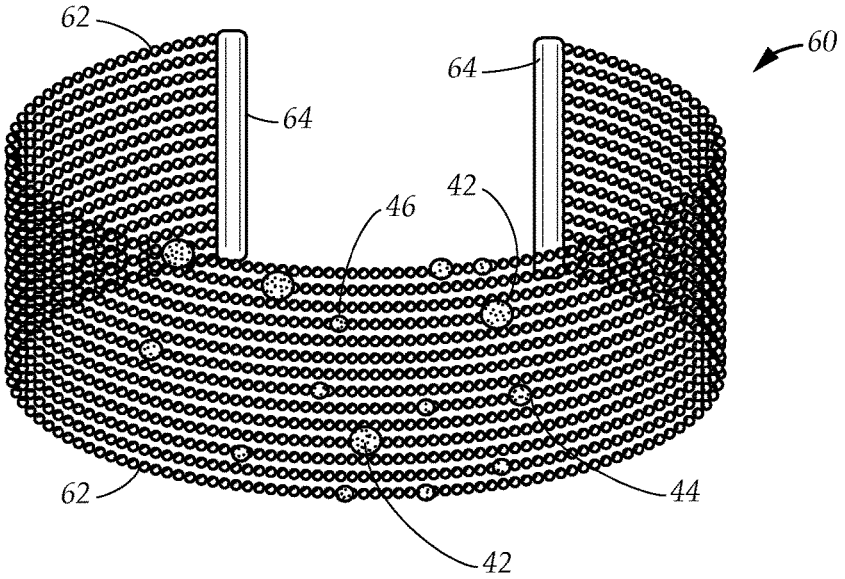
FIG. 10 is a perspective view of a multiple strand bracelet on a cuff with a plurality of stones positioned according to the star chart template.

FIGS. 9-10 demonstrate how a linear multiple strand jewelry piece 60 is created. A linear transparency 50 is placed overlaying the template 20 that is created as explained hereinabove. Note that FIG. 9 shows an abbreviated template 20 for the purpose of this illustration, but it is the identical template. In this non-limiting example, the linear multiple strand jewelry is created to match the necklace shown in FIG. 8.

In FIG. 9, the star positions and star magnitudes are transferred onto the linear jewelry transparency 50 by overlaying the linear jewelry transparency 50 on top of the template 20 and marking the star position and star magnitude symbol 22, 24, 26 onto a line 54 or an outer line 52 on the transparency. It is understood that the number of strands is not a limitation. The transparency further indicates placement of a pair of members 58 of a dual clasp.

In the situation that the linear multiple strand jewelry piece 60 is not coordinated with another piece, the step of transferring the star positions and star magnitudes symbols 22, 24, 26 includes adjusting the linear jewelry transparency 50 over the template 20 to create an aesthetically pleasing, balanced representation of how the stars in the sky would appear.

To create the final jewelry piece 60 shown in FIG. 10, a plurality of gemstones 42, 44, 46 are matched to the star magnitude symbols 22, 24, 26, the lower the magnitude of the star, the larger the gemstone. A plurality of strands 62 in the multiple strand piece 60 are formed by replicating the transparency shown in FIG. 7-9 stringing a gemstone matching the magnitude of the star symbol onto the strand matching the position of the star symbol on the transparency 50. The larger gemstones 42 are placed where the brightest star magnitude symbol 22 is indicated on the transparency 50; the smallest gemstone where the highest magnitude symbol 26 is indicated and the intermediate size gemstone 44 where the intermediate magnitude symbol 24 is indicated.

Referring to FIGS. 9 and 10, once the strands 62 are created, the strands having a pair of ends, a dual clasp 64 is attached to the ends of strands, the dual clasp 64 having two members 58, one part to the end of each strand 62, maintaining the strands in position replicating the transparency 50 shown in FIG. 9.

Summarizing the method the method for creating the multiple strand piece of jewelry as illustrated in FIGS. 1-10, comprises creating a star chart based on a specific time and a specific place; classifying a plurality of stars in the star chart by magnitude; creating a template based on the star chart, indicating star position and star magnitude for each of stars; transferring the star positions and star magnitudes onto a multiple strand jewelry transparency by overlaying the multiple strand jewelry transparency on top of the template, the multiple strand jewelry transparency comprising a plurality of lines indicating a plurality of strands in the multiple strand jewelry, placing the star position and star magnitude onto a line on the transparency; matching a plurality of gemstones to the stars in the star chart, the lower the magnitude of the star, the larger the gemstone; and creating a plurality of strands in the multiple strand piece by replicating the transparency, stringing a gemstone matching the magnitude of the star onto the strand matching the position of the star.

Further, a document explaining the significance of the specific time and specific place along with the significance of the gemstones based on ancient symbolism can be prepared and included with the piece of jewelry.

Figure 11:
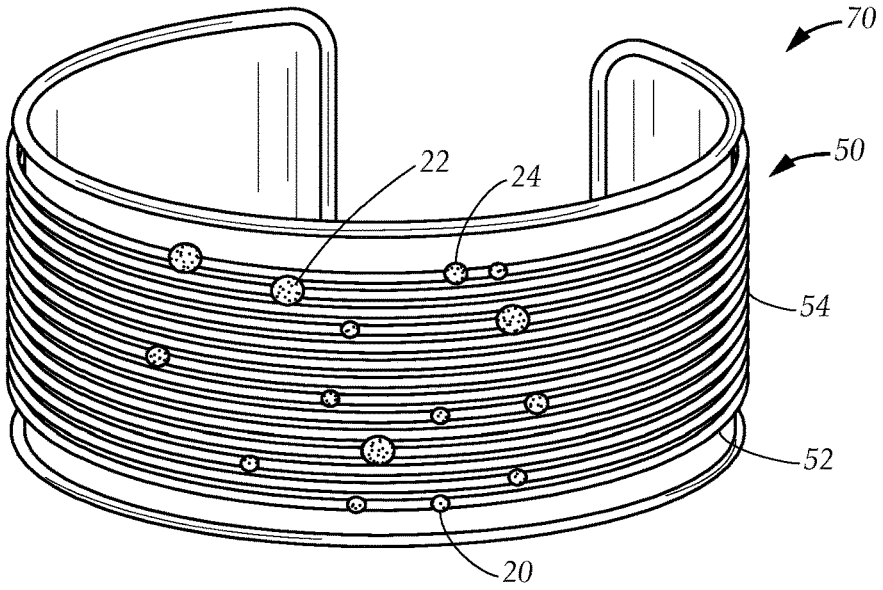
FIG. 11 is a perspective view of multiple strand linear jewelry piece transparency overlaying a cuff bracelet template

FIGS. 10 and 11 illustrate a method for creating a solid piece of jewelry, which in the illustration is a cuff bracelet 80. In this case the transparency 50 created for the bracelet 60 is applied to a cuff template 70. The template 70 may be curved to replicate the cuff bracelet in three dimensions, or a two-dimensional representation. The transparency 50 shows the star magnitude symbols 22, 24, 26 and uses the outer lines 52 to align with a pair of edges 82 of the cuff bracelet 80. The inner lines 54 facilitate positioning of the gemstones 42, 44, 46 that are matched to the star magnitude symbols 22, 24, 26, on the template 70. The gemstones 42, 44, 46 are affixed to the cuff 80 in the positions indicated on the transparency.

While a solid collar necklace is not shown, it can be created by the transparency 30 shown in FIG. 7 using the innermost line 32 and the outermost line 28 to align the transparency with the collar necklace and affixing the gemstones according to the method described hereinabove.

Solid jewelry can be constructed from many materials, such as but not limited to, metals including precious metals such as gold, silver, copper, platinum and alloys of precious metals as well as non-metallic materials, such as leather, artificial leather, plastics such acrylics as non-limiting examples.

Figure 12:
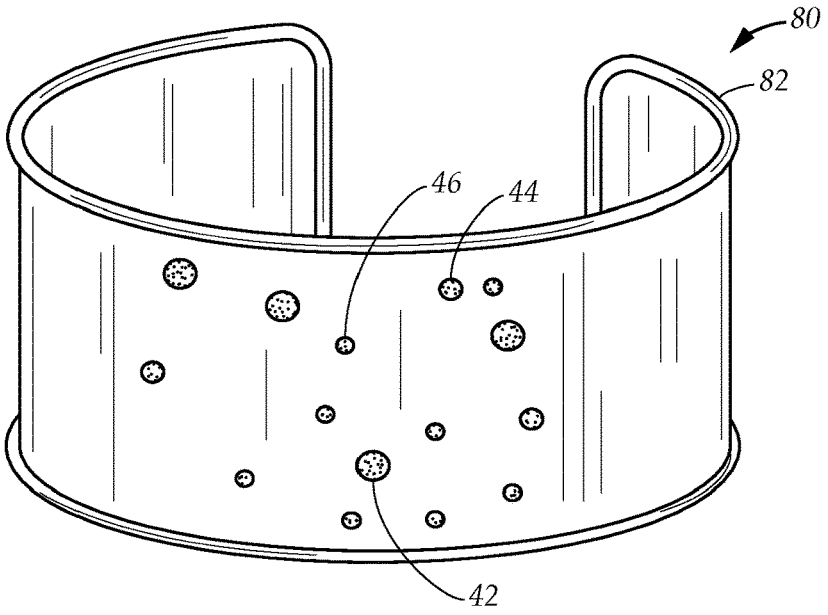
FIG. 12 is a perspective view of a cuff bracelet with a plurality of stones positioned according to the star chart template.

Summarizing the method the method for creating the solid piece of jewelry, as illustrated in FIGS. 11-12, comprises creating a star chart based on a specific time and a specific place; classifying a plurality of stars in the star chart by magnitude; creating a template based on the star chart, indicating star position and star magnitude for each of the stars; transferring the star positions and star magnitudes onto a jewelry transparency by overlaying the jewelry transparency on top of the template, placing the star position and star magnitude onto the transparency; matching a plurality of gemstones to the stars in the star chart, the lower the magnitude of the star, the larger the gemstone; and creating the jewelry piece by replicating the transparency, affixing a gemstone matching the magnitude of the star onto the jewelry piece matching the position of the star.

The system for creating jewelry that recreates a specific star pattern onto a jewelry piece comprises a star chart for a specific place and a specific time generated by at least one software application; a template created from said star chart indicating star magnitude, the template having a plurality of stars classified by magnitude; a transparency for a jewelry piece that overlays the template; and a plurality of gemstones of at least one type of gemstones, the gemstones classified by size and type, the number of classes of gemstones matching the classes of star magnitude.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented methods and systems for creating jewelry that recreates a star pattern in the sky at a specific time and specific place. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method for creating a multiple strand piece of jewelry, comprising:

creating a star chart based on a specific time and a specific place, wherein the star chart shows a plurality of stars;

classifying the plurality of stars shown by the star chart by magnitude, wherein the classifying creates a number of classes;

creating a template based on the star chart, wherein the template indicates a star position and a star magnitude for each of the plurality of stars;

transferring the star positions and star magnitudes onto a multiple strand jewelry transparency by overlaying the multiple strand jewelry transparency over the template, the multiple strand jewelry transparency comprising a plurality of lines indicating a plurality of strands in the multiple strand piece of jewelry, marking the star position and a symbol representing the star magnitude for each of the plurality of stars onto the multiple strand jewelry transparency;

matching a plurality of gemstones to the stars in the star chart, the lower the magnitude of the star, the larger the gemstone; and forming a plurality of strands in the multiple strand piece of jewelry by replicating the lines of the multiple strand jewelry transparency with the plurality of strands, and stringing each of the plurality of gemstones onto one of the plurality of strands, wherein a position of each of the strung plurality of gemstones corresponds to the star position of the respective star that is matched to the respective gemstone.

2. The method as described in claim 1, wherein the step of transferring the star positions and star magnitudes onto the multiple strand jewelry transparency by overlaying the multiple strand jewelry transparency on the template, includes adjusting the multiple strand jewelry transparency to create an aesthetically pleasing, balanced representation.

3. The method as described in claim 1, further comprising attaching a dual clasp to the strands, the strands having a pair of ends, the dual clasp having two members, one of the two members attaching to one end of the pair of ends of each strand, maintaining the strands in position replicating the transparency.

4. The method as described in claim 1, wherein the specific place is described by a longitude and a latitude.

5. The method as described in claim 1 wherein the magnitude of the star is apparent magnitude.

6. The method as described in claim 1, wherein the strands are linear.

7. The method as described in claim 1, wherein the strands are arcuate.

8. The method as described in claim 1, wherein the multiple strand jewelry is selected from the group consisting of a necklace, a bracelet, an earring, an ankle bracelet and a belt.

9. A method for creating a solid jewelry piece, comprising:

creating a star chart based on a specific time and a specific place, wherein the star chart shows a plurality of stars;

classifying the stars in the star chart by magnitude;

creating a template based on the star chart, wherein the template indicates a star position and a star magnitude for each of the plurality of stars;

transferring the star positions and star magnitudes onto a jewelry transparency by overlaying the jewelry transparency over the template, the jewelry transparency comprising an outline of a solid jewelry piece, marking the star positions and a symbol for each of the respective star magnitudes onto the transparency;

matching a plurality of gemstones to the stars in the star chart, the lower the magnitude of the star, the larger the gemstone;

creating the solid jewelry piece by replicating the transparency, wherein the plurality of gemstones are affixed onto a solid piece and a position of each of the plurality of gemstones corresponds to the star position of the respective star that is matched to the respective gemstone.

10. The method as described in claim 9, wherein the step of transferring the star positions and star magnitudes onto the jewelry transparency by overlaying the jewelry transparency over the template, includes adjusting the jewelry transparency to create an aesthetically pleasing, balanced representation.

11. The method as described in claim 9, wherein the specific place is described by a longitude and a latitude.

12. The method as described in claim 9, wherein the magnitude of the star is apparent magnitude.

13. The method as described in claim 9, wherein the solid jewelry piece is selected from the group consisting of a collar necklace, an earring and a cuff bracelet.

* * * * *